US005970552A

United States Patent [19]

Kwiecien et al.

[11] Patent Number: 5,970,552

[45] Date of Patent: Oct. 26, 1999

[54] SCAFFOLD PRYBAR RATCHET

[75] Inventors: Lester H. Kwiecien, Chicago; Paul L. Armstrong, II, Wilmette, both of Ill.

[73] Assignee: Hand Tool Design Corporation, Wilmington, Del.

[21] Appl. No.: 09/017,911

[22] Filed: Feb. 3, 1998

[51] Int. Cl.[6] ..... B25F 1/00

[52] U.S. Cl. ..... 7/143; 7/166; 7/138; 81/63

[58] Field of Search ..... 81/58–63.2; 7/138, 7/143, 166; D8/25, 81

[56] References Cited

U.S. PATENT DOCUMENTS

| | | | |
|---|---|---|---|
| D. 53,613 | 7/1919 | Rockwell . | |
| D. 156,732 | 1/1950 | Hoeflicker | D54/16 |
| D. 208,068 | 7/1967 | Rando | D54/13 |
| D. 276,125 | 10/1984 | Wright et al. | D8/25 |
| 1,472,517 | 10/1923 | Fry . | |

OTHER PUBLICATIONS

Snap–On Catalog No. 400, dated 1997, p. 96, item N (stock No. S717).

Wright Tool Catalog No. 9801/100 CAT, dated 1998, p. 146, part No. 4482.

*Primary Examiner*—D. S. Meislin

*Attorney, Agent, or Firm*—Leonard Bloom

[57] ABSTRACT

A ratchet tool for assembly and disassembly-of a scaffold has a handle, a hammer tip, a ratchet gear, a socket and a prybar. The hammer tip is connected to a disc driver which has a male portion to engage a slot in the top of the gear allowing the gear to be turned manually. Thus the socket connected to the gear may be turned manually by finger turning of the hammer head. A prybar is formed on the end of the handle opposite from the head of the tool.

12 Claims, 6 Drawing Sheets

SCAFFOLD PRYBAR RATCHET

The present invention relates to a scaffold ratchet and more particularly, to a scaffold ratchet having a replaceable hammer head, a prybar and finger spin ratchet action.

BACKGROUND OF THE INVENTION

In the assembly and disassembly of scaffolds, the worker does not have a convenient space to store a multiple of tools needed for the task. Further, the worker is in a high hazard area where it is desirable to have as few tools to control as possible and also where simplicity of operation of a tool is highly desired. It has been customary for workers in the field to modify existing tools such as a ratchet wrench, a hammer and/or a prybar to form a single tool which has all of these features. For example, a prybar would be welded onto a ratchet. This tool provides a safer solution. At the present time, there is no single tool available which has all the features required by workers who assemble and disassemble scaffolds.

The applicant is aware of two scaffold wrenches which are presently available. Snap-on Tool Co. model S717 has a handle, a hammer tip and a reversible socket. The socket cannot be turned by manual rotation of the hammer tip. The Wright Tool and Forge Co. has model 4482 similar to U.S. Pat. No. Des. 276,125 except that the patent does not disclose a hammer tip. Also, the socket can be turned clockwise by hand but rotation in a counterclockwise direction unscrews the hammer tip from the wrench.

Combination tools are also known. In U.S. Pat. No. 1,472,517, Fry discloses a wrecking tool having a handle, a penetrating pinch-bar at one end of the handle and a curved head with a claw at the other end. A hammer head is formed on one side of the head. The tool does not have a socket or a ratchet. Rockwell, in U.S. Pat. No. Des. 53,613 discloses a design for a combination tool having a pinch-bar at one end of a handle and a claw at the other end of the handle. A hammer head is formed on one side of the claw. This tool, also, does not have a socket or a ratchet. Hoeflicker in U.S. Pat. No. Des. 156,732, discloses a design for a combination tool having a screwdriver head at one end of a handle and an open-end adjustable wrench at the other end with a hammer head at one jaw of the wrench. In U.S. Pat. No. Des. 208,068, Rando discloses a design for a combination tool having a chisel-like tool at one end of a handle, an open end adjustable wrench at the other end of the handle, and a hammer head and claw approximately mid-way between the two ends.

There remains a need for a more versatile, easily usable multipurpose tool which can be used safely in hazardous situations in the assembly and disassembly of a scaffold.

BRIEF SUMMARY OF THE INVENTION

It is an object of the present invention to provide a multipurpose tool which can be used safely in assembling and disassembling a scaffold.

It is a further object to provide a single tool which has a hammer tip, a ratcheting socket and a prybar.

It is another object to provide a tool wherein the socket and the fastener held therein may be rotated in on and off directions by finger spin action by the user without backing out.

In accordance with the teachings of the present invention, there is disclosed a ratchet tool used in the assembly and disassembly of a scaffold. The tool bar has a handle having a first end and an opposite second end. The first end is connected to a head having an opening therein. A replaceable hammer tip is removably received on the opening in the head. The hammer tip has an upper driving face disposed above the opening in the head and an opposite face having means thereon to engage a fastener. A disc driver has a through opening therein and a male portion is formed on a face of the disc driver. The disc driver is disposed in the opening in the head such that the male portion of the disc driver is distal from the hammer tip and the means on the hammer tip to engage the fastener extends through the through opening in the disc driver. A fastening means is provided to secure the engaging means on the hammer tip to the disc driver. A gear is received in the opening in the head juxtapositioned to the disc driver and the fastening means. The gear has a plurality of axial teeth formed circumferentially thereabout. A tang is formed on the gear distal from the hammer tip and a slot is formed laterally across the gear opposite from the tang. The male portion of the disc driver cooperates with the slot in the gear. In this manner the tool has a hammer tip for hammering components of the scaffolding, and a socket may be received on the tang for tightening and loosening fasteners on the scaffold. The second end of the handle is chamfered to form a prybar to separate components in the scaffold.

In further accordance with the teachings of the present invention, there is disclosed a ratchet tool used in the assembly and disassembly of a scaffold. The tool includes a handle having a first end and an opposite second end. A head having an opening therein is formed on the first end of the handle. A hammer tip is received on the opening in the head. An upper portion of the hammer tip extends above the head on the handle and an opposite lower portion of the hammer tip is received on the opening in the head in the handle. Engaging means extend from the lower portion. A gear is disposed within the opening in the head. The gear has a slot formed laterally across an upper surface of the gear. A pawl engages the gear wherein the gear may be rotated in clockwise and counterclockwise directions. A socket is connected to a lower surface of the gear for turning a fastener on the scaffold. A disc driver is disposed between the lower portion of the hammer tip and the gear. The disc driver has an opening therethrough and a male portion formed on a surface of the disc driver. The engaging means of the hammer tip extends through the opening in the disc driver. A fastening means secures the engaging means of the hammer tip to the disc driver, and retains the disc driver within the opening in the head of the handle. The male portion of the disc driver is received in the slot in the gear. In this manner, the hammer tip may be rotated in clockwise and counterclockwise directions by fingers of a user's hand to tighten and loosen fasteners on the scaffold.

In another aspect of the present invention, there is disclosed a tool used for the erection and dismantling of scaffolds. The tool includes an elongated handle having a head portion, wherein a ratcheting mechanism in the head portion of the handle drives a wrench socket mounted on the tool and depending therefrom. A hammer tip is disposed above the head portion for receiving impact blows thereon. An improvement is a prybar formed on an end of the handle remote from the head portion thereof. The hammer tip is manually rotatable to rotate the wrench socket without removing the hammer tip from the tool.

These and other objects of the present invention will become apparent from a reading of the following specification taken in conjunction with the enclosed drawings.

DESCRIPTION

Figure 1:
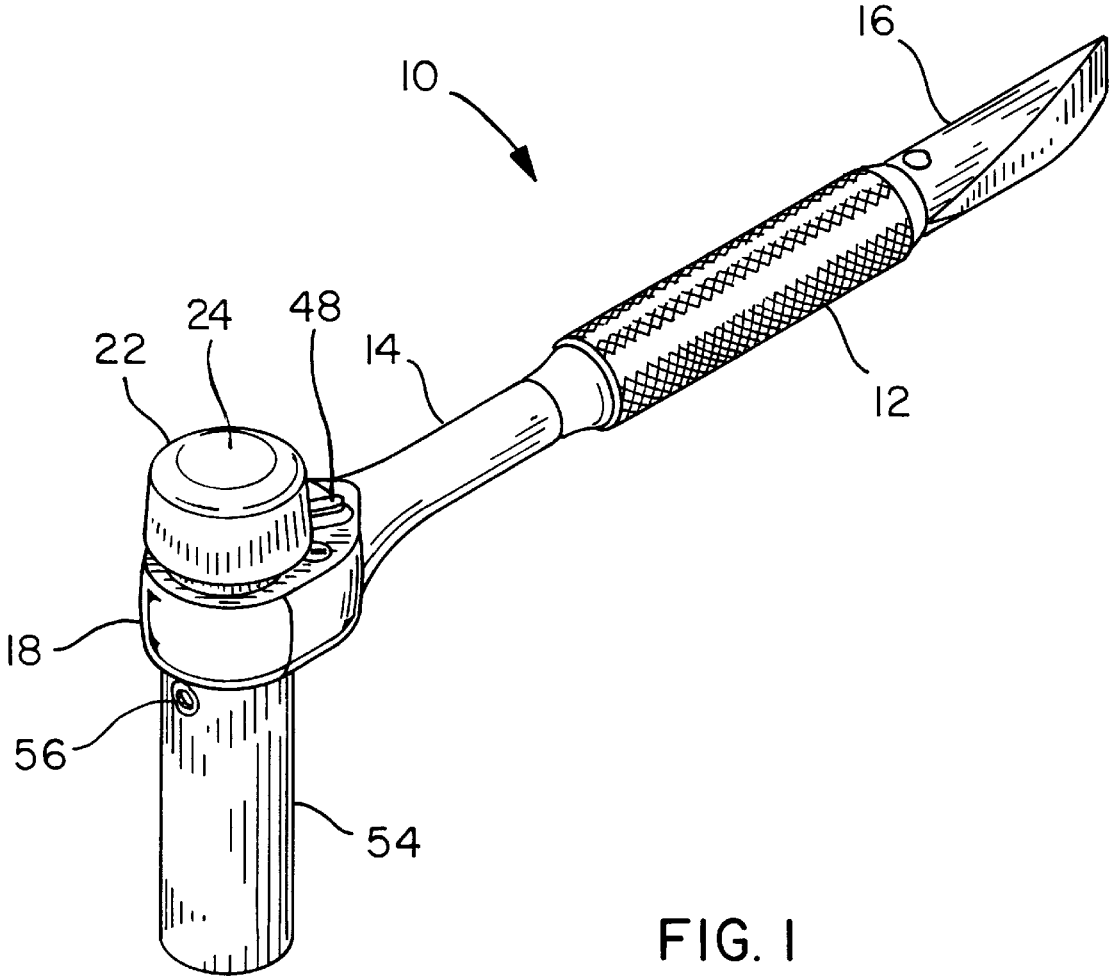
FIG. 1 is a perspective view of the scaffold ratchet tool of the present invention.
Figure 2:
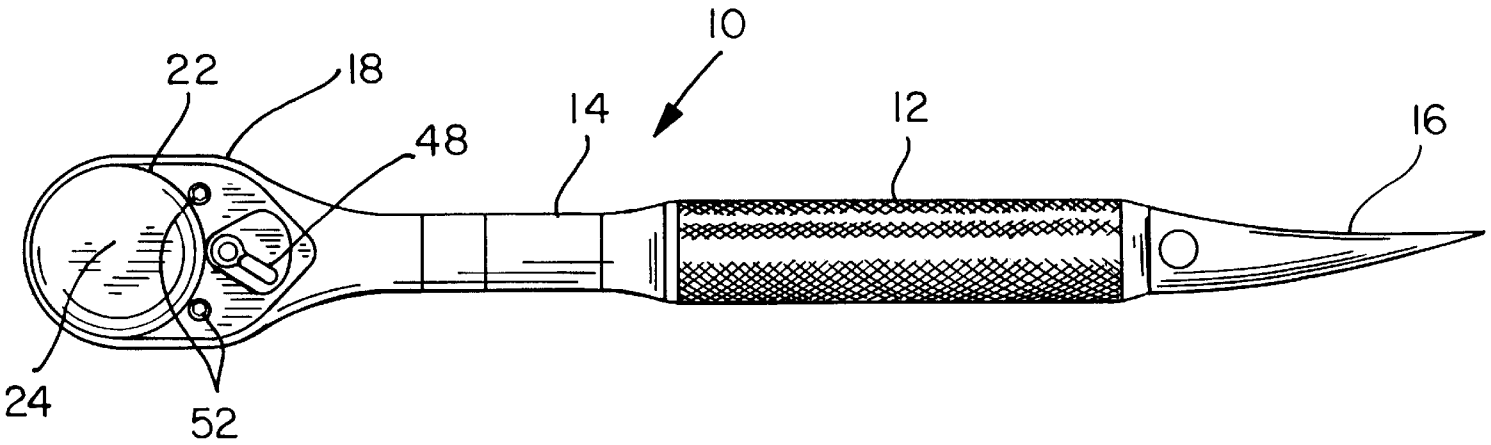
FIG. 2 is a top plan view of the scaffold ratchet tool.
Figure 3:
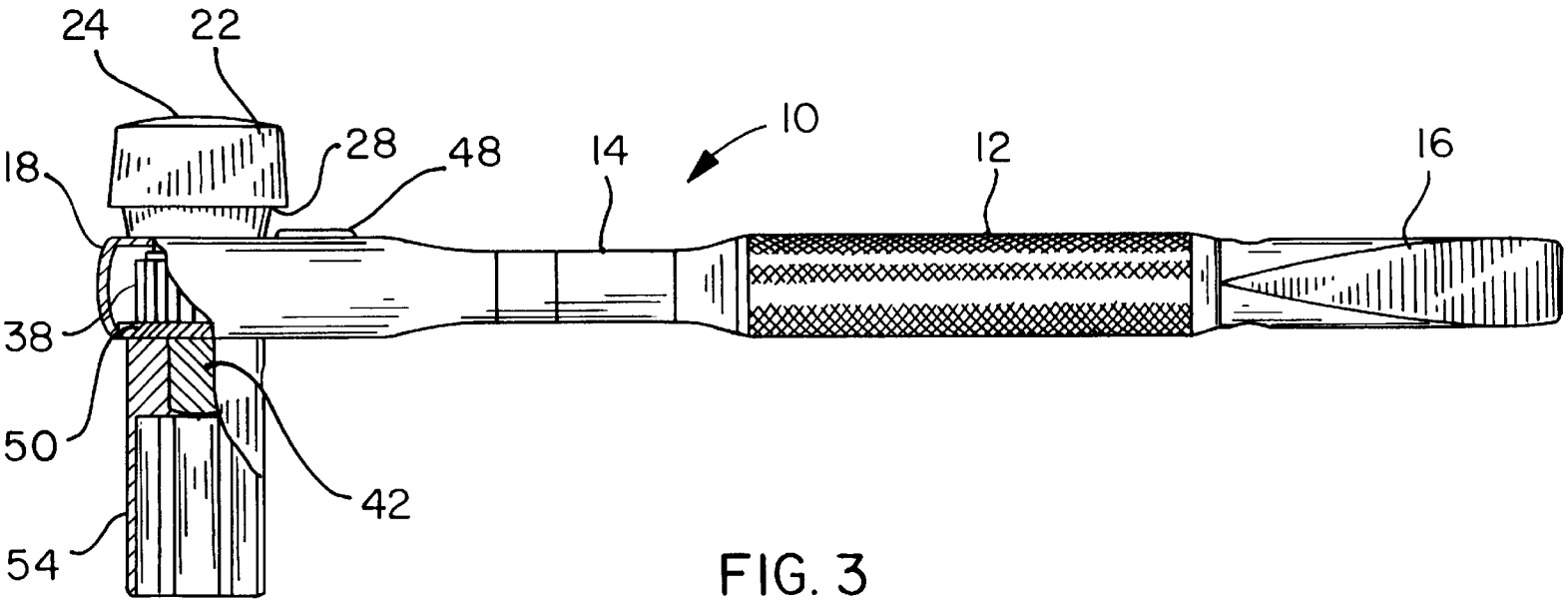
FIG. 3 is a side elevation view of the scaffold ratchet tool.

Referring now to FIGS. 1–3, the ratchet tool 10 used in assembling and disassembling a scaffold has a handle which has a first end 14 and an opposite second end 16. The first end 14 of the handle 12 is connected to a head 18 which has a through opening 20 formed therein. The portion of the handle 12 between the first end 14 and the second end 16, preferably has a knurled surface to improve the ability of the user to grasp the handle 12. The second end 16 of the handle 12 preferably is chamfered to form a prybar 16.

A replaceable hammer tip 22 is removably received on the opening 20 in the head 18. The hammer tip 12 is formed of metal or durable, tough plastic and has an upper driving face 24. The opposite lower face has formed thereon a means to engage a fastener 26 as will be described. This means may be a threaded shaft 26 which extends substantially perpendicularly from the lower face of the hammer tip 22. The hammer tip 22 also may have a shoulder 28 formed on the lower face from which the threaded shaft 26 extends, wherein the shoulder 28 is seated on the opening 20 in the head 18 to properly position the hammer tip 22. A hammer tip 22 of this type is commercially available. The hammer tip 22 is received in the opening 20 with a close tight fit formed between the hammer tip 22 and the head 18 of the tool to minimize the penetration of foreign substances into the head 18 and to eliminate direct transfer of hammer tip (22) shocks directly to the gear 38.

Figure 5:
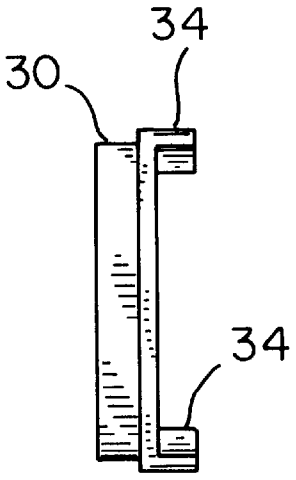
FIG. 5 is an end view of the driver disc.
Figure 4:
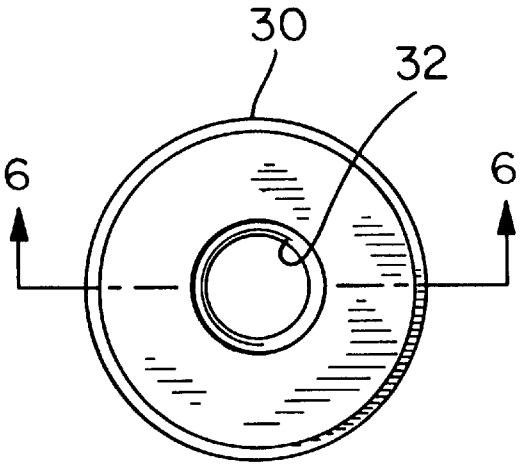
FIG. 4 is a top plan view of the driver disc.
Figure 6:
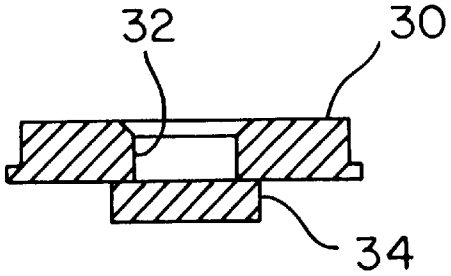
FIG. 6 is a cross section view taken across the lines 6—6 of FIG. 4.
Figure 9:
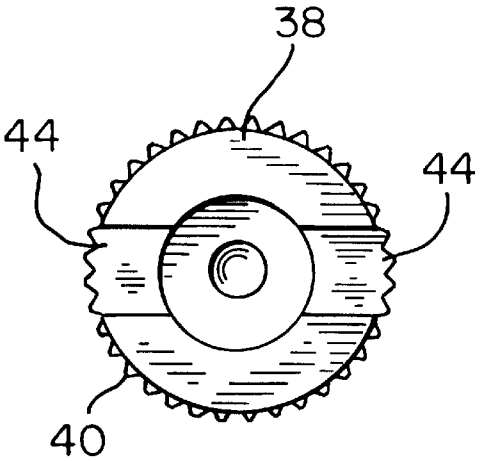
FIG. 9 is a top plan view of the gear showing the slot.
Figure 8:
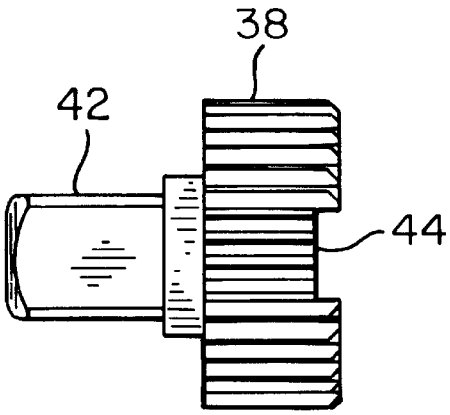
FIG. 8 is a side elevation view of the gear showing the slot and the tang.
Figure 7:
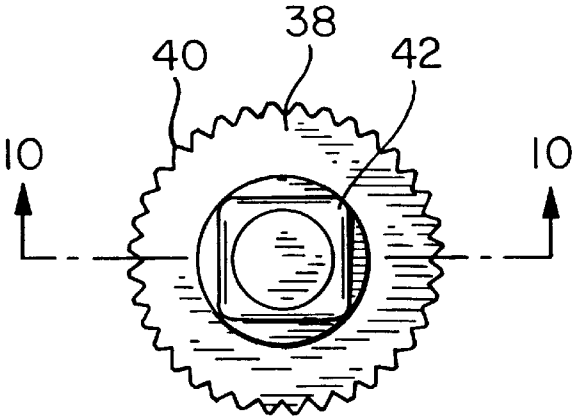
FIG. 7 is a bottom plan view of the gear.
Figure 10:
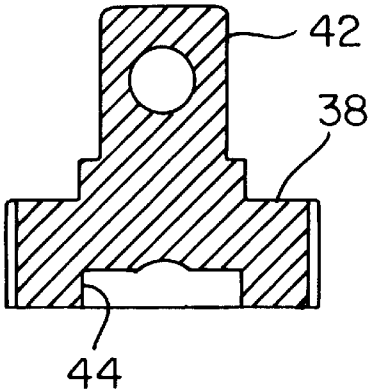
FIG. 10 is a cross sectional view taken across the lines 10—10 of FIG. 7.
Figure 11:
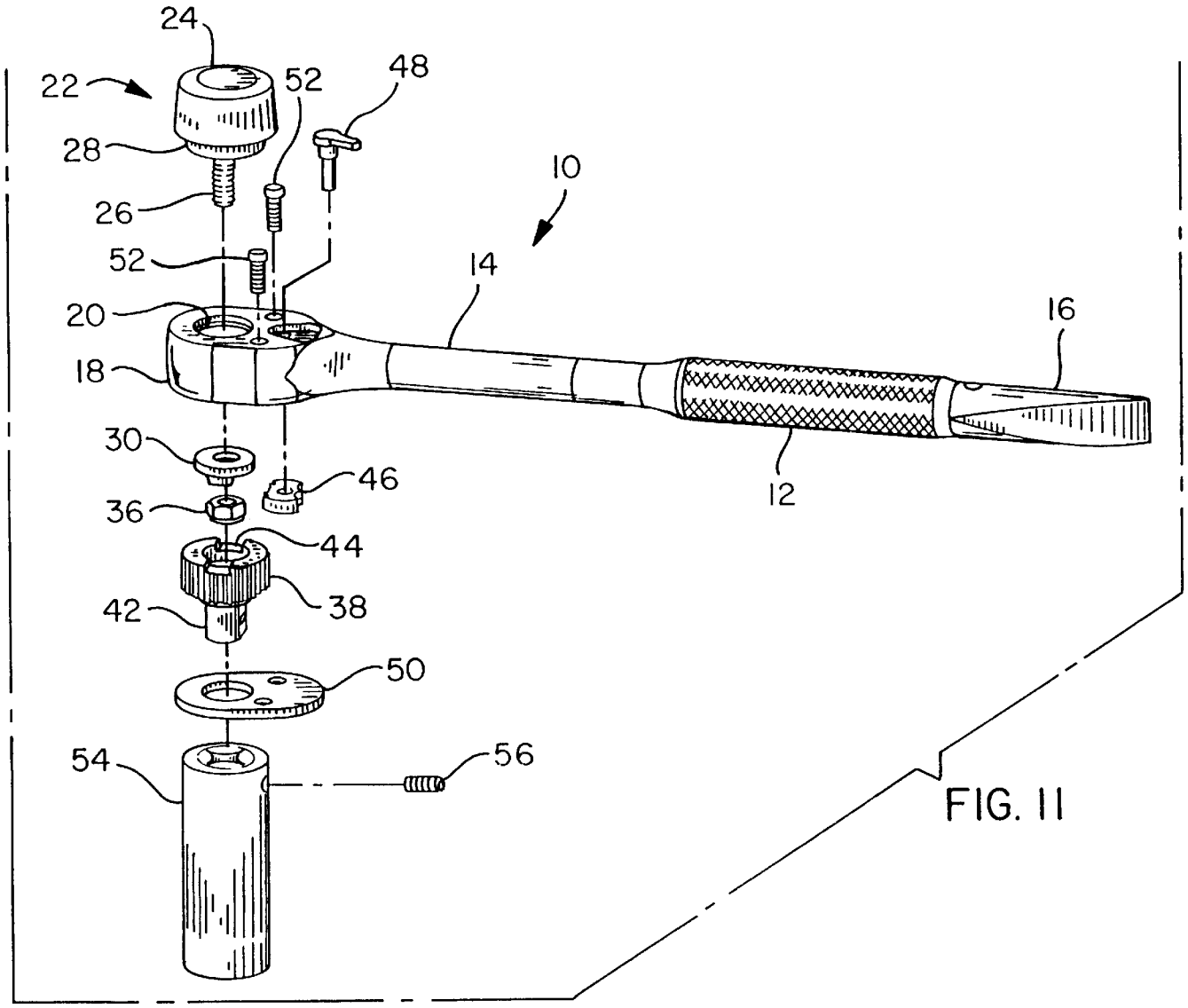
FIG. 11 is an exploded view of the scaffold ratchet tool.
Figure 13:
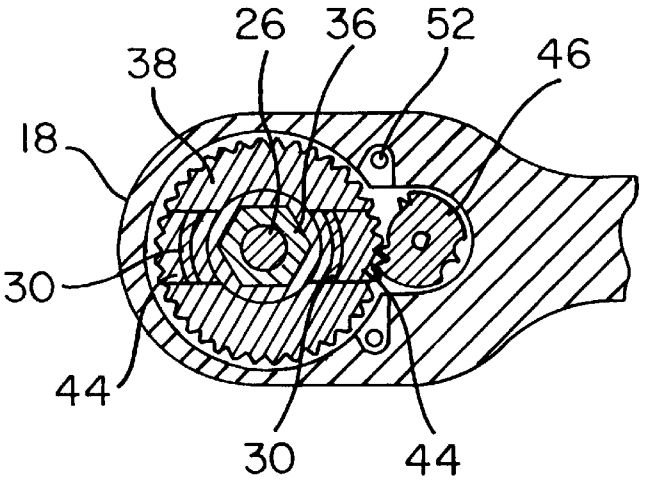
FIG. 13 is a cross sectional view taken across the lines 13—13 of FIG. 12.
Figure 12:
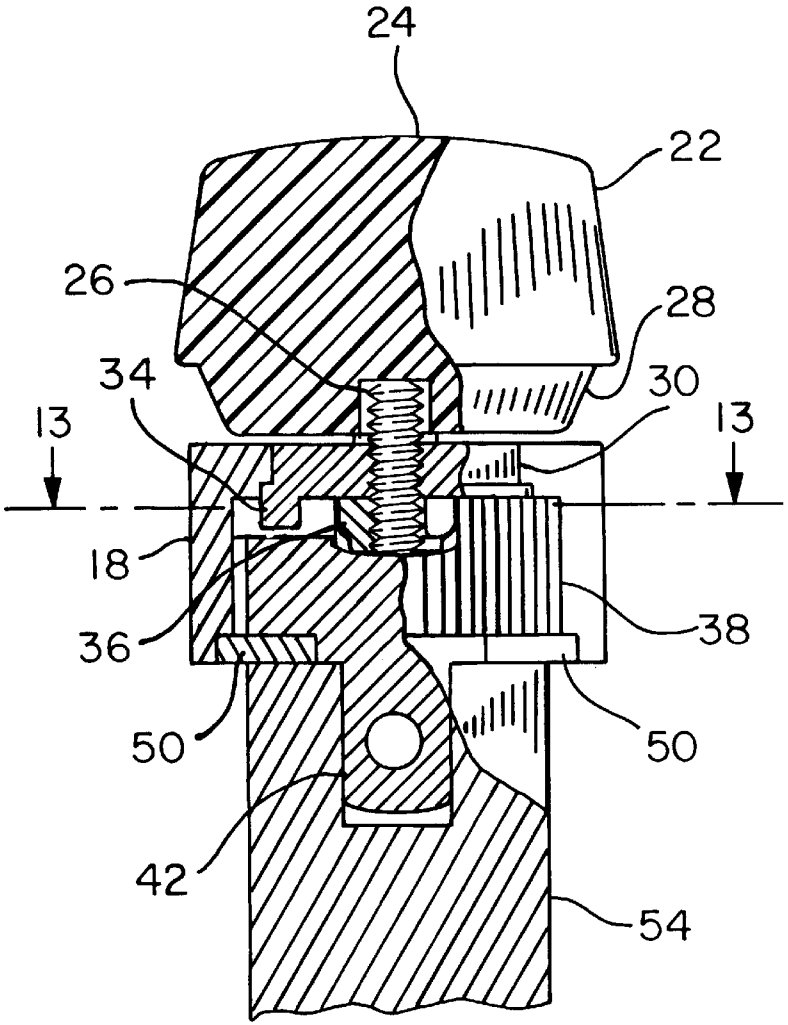
FIG. 12 is a cross sectional view taken across the lines 12—12 of FIG. 3.

Disposed within the opening 20 in the head 18 is a disc driver 30 as shown in FIGS. 4–6. The disc driver 30 is introduced from the bottom of the head. There is a shoulder formed in the opening 20 in the head 18 adjacent to the top surface of the head and the disc driver 30 abuts the shoulder so that the driver disc is retained within the opening 20. A center hole 32 is formed in the disc driver 30. Preferably, the center hole 32 is threaded to cooperate with the threaded shaft 26 on the hammer tip 22. A male portion 34 is formed on one surface of the disc driver 30, the male portion 34 being oriented distal from the hammer tip 22 when the disc driver 30 is disposed within the opening 20 in the head 18 of the tool 10. It is preferred that the male portion 34 be two diametrically opposed members which are on the periphery of the disc driver 30. The means to engage a fastener 26 (e.g., the threaded shaft) on the hammer tip 22 extends through the hole 32 in the disc driver 30.

A fastening means 36 such as a threaded fastener is disposed in the opening 20 in the head of the tool 10, adjacent to the disc driver 30 and distal from the hammer tip 22. The fastening means 36 is engaged by the means to engage a fastener 26 on the hammer tip 22. An example is a threaded lock nut 36 which cooperates with the threaded shaft 26. Alternately, the fastening means 36 may be an adhesive to secure the threaded shaft 26 to the disc driver 30.

Referring to FIGS. 7–10, a gear 38 is received in the opening 20 in the head 18 of the tool 10. The gear 38 is juxtapositioned to the disc driver 30. The gear 38 has plurality of axial teeth 40 formed circumferentially about the gear. Preferably a standard gear 38 is used which has thirty-six gear teeth for 10° ratchet action. A tang 42 is formed on the gear distal from the hammer tip 22. A slot 44 is formed laterally across the diameter of the gear 38 in the surface proximal to the hammer tip 22 and opposite from the tang 42. When disposed in the head 18 of the tool 10, the male portion 34 of the disc driver 30 is keyed to, and cooperates with the slot 44 in the gear 38 such that rotation of the disc driver 30 produces rotation of the gear 38.

A pawl 46 is disposed within the opening 20 in the head 18 of the tool. The teeth on the pawl 46 engage the teeth 40 on the gear 38. A reversing lever 48 is connected to the pawl 46 to provide means to ratchet the gear in a forward and an opposite reverse direction.

A bottom plate 50 is provided to retain the components within the opening 20 in the head 18 of the tool 10. An opening is provided in the bottom plate through which the tang 42 extends. Preferably, at least one threaded screw 52 extends from the top of the head 18 through the bottom plate 50 to secure the bottom plate 50 to the tool 10.

A socket 54 is received on the tang 42. Preferably, the socket 54 is an six (6) point ⅞ inch socket since scaffolds are most commonly assembled with a ⅞ inch fastener. It is further preferred that a threaded set screw 56 be used to secure the socket 54 to the tang 42.

The prybar end 16 of the handle 12 is used to separate parts of the scaffold. This prybar feature is especially useful with the replacement end connector assembly of the "positive lock system" scaffold when it is necessary to lift the retainer. The hammer tip 22 is used to drive a wedge in the "positive lock system" scaffold and to adjust the tube and clamp offset in the "tube and clamp" type of scaffold. The hammer tip 22 makes positive contact with the top surface of the head 18 of the tool 10 for direct transfer of force between the hammer tip 22 and the head 18 and eliminates hammer shocks from transferring to the internal parts within the head 18. The hammer tip 18 is replaceable, if damaged, by disassembling the tool and removing the fastening means 36 (the nut) from the means to engage the fastener 26 (the threaded shaft). The ratcheting socket is used for the fasteners on either type scaffold.

An especially useful feature of the present invention is the finger tip ratchet control wherein the user can rotate the hammer tip 22 in a desired clockwise or counterclockwise direction by using the fingers of the user's hand after placing the reversing lever 48 in the desired position. Manual rotation of the hammer tip 22 produces corresponding rotation of the socket 54 and of the fastener in the scaffold which is held in the socket 54. This is accomplished because of the cooperation between the male portion 34 of the disc driver 30 with the slot 44 in the gear 38. The hammer tip 22 acts as a spinner knob. This spinner action is performed before applying final torque or after breaking the fastener loose by using leverage of the handle 12. This feature permits the person in a high hazardous work area to tighten or loosen the fasteners with less movement of the arms and, consequently, is safer. When used in this manner, the hammer tip does not unscrew or become separated from the tool under normal forces required.

There is no need for the user of the tool 10 of the present invention to touch the fastener in the scaffold with his fingers during scaffold assembly and/or disassembly. The finger ratchet action as described above allows easy and quick turning of the fastener by using the hammer tip as a spinner knob. The overall time and amount of swing clearance required for erecting the scaffold is greatly improved due to the spinning of the socket manually before the final torque is applied and after the fastener has been broken loose. The present invention eliminates the need for multiple tools and assures that tool modifications will not be required in accordance with safe user requirements enforced by safety departments.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A ratchet tool used in the assembly and disassembly of a scaffold comprising:

a handle having a first end and an opposite second end, the first end being connected to a head having an opening therein, a replaceable hammer tip removably received on the opening in the head, the hammer tip having an upper driving face disposed above the opening in the head and an opposite face having means thereon to engage a fastener, a disc driver having a through opening thereon and a male portion formed on a face of the disc driver, the disc driver being disposed in the opening in the head such that the male portion of the disc driver is distal from the hammer tip and the means on the hammer tip to engage the fastener extends through the through opening in the disc driver, a fastening means to secure the engaging means on the hammer tip to the disc driver, a gear received in the opening in the head juxtapositioned to the disc driver and the fastening means, the gear having a plurality of axial teeth formed circumferentially thereabout, a tang formed in the gear distal from the hammer tip and a slot formed laterally across the gear opposite from the tang, wherein the male portion of the disc driver cooperates with the slot in the gear, such that the tool has a hammer tip for hammering components of the scaffolding, and a socket may be received on the tang for tightening and loosening fasteners on the scaffold.

2. The ratchet tool of claim 1, wherein the second end of the handle is chamfered to form a prybar to separate components in the scaffold.

3. The ratchet tool of claim 1, further comprising a pawl disposed in the opening in the head, the pawl engaging the gear, a reversing lever connected to the pawl for driving the gear in a forward and a reverse position to ratchet the socket on the tool.

4. The ratchet tool of claim 1, wherein the means on the hammer head to engage the fastener is a threaded shaft and the fastening means is a cooperatively threaded lock nut.

5. The ratchet tool of claim 1, wherein the hammer head is received on the opening in the head of the tool with a close fit formed between the hammer tip and the ratchet tool to minimize penetration of foreign substances therebetween.

6. The ratchet tool of claim 1, wherein the hammer tip makes positive contact with a top face of the head of the tool such that there is a direct transfer of force between the hammer tip and the head of the tool.

7. A ratchet tool used in the assembly and disassembly of a scaffold comprising:

a handle having a first end and an opposite second end, a head having an opening therein formed on the first end of the handle, a hammer tip received on the opening in the head, an upper portion of the hammer tip extending above the head on the handle, an opposite lower portion of the hammer tip received on the opening in the head in the handle, engaging means extending from the lower portion, a gear disposed within the opening in the head, the gear having a slot formed laterally across an upper surface of the gear, a pawl engaging the gear wherein the gear may be rotated in clockwise and counterclockwise directions, a socket connected to a lower surface of the gear for turning a fastener on the scaffold, a disc driver disposed between the lower portion of the hammer tip and the gear, the disc driver having an opening therethrough and a male portion formed on a surface of the disc driver distal from the hammer tip, the engaging means of the hammer tip extending through the opening in the disc driver, a fastening means securing the engaging means of the hammer tip to the disc driver, and retaining the disc driver within the opening in the head of the handle, the male portion of the disc driver being received in the slot in the gear, wherein the hammer tip may be rotated in clockwise and counterclockwise directions by fingers of a user's hand to tighten and loosen fasteners on the scaffold.

8. The ratchet tool of claim 7, wherein the second end of the handle is chamfered to form a prybar to separate components of the scaffold.

9. A ratchet tool used in assembling and disassembling of a scaffold comprising:

a handle having a first end and an opposite second end, the second end being chamfered to form a prybar, the first end being connected to a head, a through opening being formed in the head, a hammer tip having an upper hammer head portion extending above the head and a lower portion being received on the opening in the head, a gear having axial teeth disposed within the opening in the head, a pawl disposed in the opening of the head, a reversing lever connected to the pawl, the pawl engaging the axial teeth on the gear such that the gear may be rotated in a first direction and an opposite second direction, a socket connected to the gear, means to engage the lower portion of the hammer tip with the gear wherein fingers of a user's hand may rotate the upper portion of the hammer tip in the first direction and the second opposite direction to produce concomitant rotation of the socket and leveraging the handle provides torque to securely fasten or loosen a fastener in the scaffold.

10. The ratchet tool of claim 9, wherein the means to engage the lower portion of the hammer tip with the gear is a threaded shaft extending from the lower portion of the hammer tip, a disc driver disposed between the lower portion of the hammer tip and the gear, the disc driver having an opening therethrough and a male portion formed on a surface of the disc driver distal from the hammer tip, the threaded shaft extending through the opening in the disc driver, a fastening means received on the threaded shaft to secure the threaded shaft to the disc driver, a slot formed in the gear, and the male portion of the disc driver being received in the slot in the gear.

11. The ratchet tool of claim 10, wherein the fastening means is a threaded fastener threadingly received on the threaded shaft.

12. In a tool which includes an elongated handle having a head portion, the head portion of the handle having a gear and ratcheting mechanism therein, a wrench socket connected to the gear and depending therefrom, a hammer tip having a lower portion and an upper portion, the upper portion being disposed above the head portion for receiving impact blows thereon, the improvement which comprises a prybar formed on an end of the handle remote from the head portion thereof, the lower portion of the hammer tip being connected to a disc driver, the disc driver cooperating with the gear, the upper portion of the hammer tip being manually rotatable with respect to the head portion wherein rotation of the hammer tip rotates the disc driver and moves the gear to rotate the wrench socket without removing the hammer tip from the tool.

* * * * *